US010393386B2

(12) United States Patent
Gasparini et al.

(10) Patent No.: US 10,393,386 B2
(45) Date of Patent: Aug. 27, 2019

(54) SYSTEM OF GAS BURNERS, IN PARTICULAR FOR A COOKING TOP FOR HOUSEHOLD USE

(71) Applicant: Indesit Company S.p.A., Fabriano (IT)

(72) Inventors: Alberto Gasparini, Fabriano (IT); Tiziano Lacchè, Matelica (IT)

(73) Assignee: Whirlpool Corporation, Benton Harbor, MI (US)

( * ) Notice: Subject to any disclaimer, the term of this patent is extended or adjusted under 35 U.S.C. 154(b) by 223 days.

(21) Appl. No.: 15/226,236

(22) Filed: Aug. 2, 2016

(65) Prior Publication Data

US 2017/0038077 A1 Feb. 9, 2017

(30) Foreign Application Priority Data

Aug. 3, 2015 (EP) ..... 15179580

(51) Int. Cl.
*F24C 3/08* (2006.01)
*F23D 14/08* (2006.01)

(52) U.S. Cl.
CPC ..... *F24C 3/08* (2013.01); *F23D 14/085* (2013.01); *F23D 2203/007* (2013.01); *F23D 2203/102* (2013.01); *F23D 2900/14062* (2013.01)

(58) Field of Classification Search
CPC ..... F23D 2203/007; F23D 2203/102; F23D 14/085; F23D 2900/14062; F24C 3/08
See application file for complete search history.

(56) References Cited

U.S. PATENT DOCUMENTS

| | | | | |
|---|---|---|---|---|
| 1,568,853 | A | 1/1926 | Lane | |
| 9,909,762 | B2 * | 3/2018 | Emiliani | F23D 14/06 |
| 2003/0190573 | A1 | 10/2003 | Keem | |
| 2009/0277439 | A1 * | 11/2009 | Gasparini | F23D 14/08 126/39 E |
| 2010/0326420 | A1 * | 12/2010 | Gasparini | F23D 14/08 126/39 E |
| 2014/0060517 | A1 | 3/2014 | Ren et al. | |

FOREIGN PATENT DOCUMENTS

| | | | | |
|---|---|---|---|---|
| CN | 2288371 | | 8/1998 | |
| CN | 2288371 Y | * | 8/1998 | F24C 3/08 |
| EP | 0732541 | | 9/1996 | |
| EP | 2503237 | | 9/2012 | |
| FR | 2999276 | | 6/2004 | |
| FR | 2999276 A1 | * | 6/2014 | F23D 14/06 |
| WO | 2007036772 | | 4/2007 | |

* cited by examiner

*Primary Examiner* — Gregory L Huson
*Assistant Examiner* — Brandon Nelan
(74) *Attorney, Agent, or Firm* — Price Heneveld LLP

(57) ABSTRACT

A system of gas burners for a cooktop includes a pair of concentric burners made up of an outer burner having a first cup and a first flame divider and an inner burner having a second cup and a second flame divider. The first and second flame dividers having respective first and second apertures to allow an air-gas mixture to escape and positioned to extend parallel to a vertical axis of the burners. The first cup includes a first Venturi element for supplying an air-gas mixture to a first chamber of the first cup. The second cup includes a second Venturi element for supplying an air-gas mixture to a second chamber of the second cup. The first and second Venturi elements are positioned horizontally along respective first and second axes, the first axis being located on an outside of an inner wall of the first cup.

14 Claims, 7 Drawing Sheets

SYSTEM OF GAS BURNERS, IN PARTICULAR FOR A COOKING TOP FOR HOUSEHOLD USE

CROSS-REFERENCE TO RELATED APPLICATION

This application claims priority to European Patent Application No. EP15179580.4 filed on Aug. 3, 2015, entitled "SYSTEM OF GAS BURNERS, IN PARTICULAR FOR A COOKING TOP FOR HOUSEHOLD USE," the entire disclosure of which is hereby incorporated herein by reference.

FIELD OF THE DEVICE

The present device relates to a cooking top having a gas burner.

BACKGROUND

At present, several typologies of cooking tops are available on the market, the most widespread typology using one or more gas burners, wherein the amount of heat necessary for cooking food is generated through combustion of a gas appropriately mixed with air.

Systems of burners are also known in the art, which have a substantially circular shape and have two concentric burners, typically an outer burner and an inner burner.

Such systems of burners are known as "double-crown", and have gas supply means, said supply means having a pair of gas inlet ducts associated with independent control valves, so that the two burners (i.e. the outer burner and the inner burner) can be used either together or separately in order to achieve good variability and a homogeneous distribution of the heat to be supplied to the cooking containers. As an alternative, both concentric burners may be fed by a single gas inlet duct, with an associated tap, which simultaneously feeds the different intake channels that supply the air-gas mixture to the concentric burners.

Such systems of burners further include a cup having at least one first chamber for supplying the air-gas mixture to the inner burner and at least one second chamber for supplying said air-gas mixture to the outer burner, said cup being associated with the supply means and with at least one flame divider (or cap).

The flame divider is positioned on the cooking top where the system of burners is installed, and uses the air under or above the cooking top as primary air to be mixed with the gas.

Also, the cup is usually made of die-cast aluminum, while the flame divider or cap is usually made of enameled cast iron (or brass alloy or steel) and acts as a cup closing element.

The systems of burners known in the art typically propagate a flame known as "crown flame"; a "crown flame" is a flame with a substantially radial direction of propagation, i.e., a flame that propagates outwards from the gas burner in a substantially radial direction with respect to the burner axis, and therefore in a direction which is substantially tangential to a visible surface of the cooking top. Said "crown flame", when emitted at an insufficient height above the cooking top, may cause the generation of a high level of CO, NO and $CO_2$ because of poor supply of secondary air, necessary for a proper combustion, towards the flames.

In atmospheric burners, i.e. burners wherein primary air is mixed with gas at atmospheric pressure, it is almost impossible to achieve stoichiometric values of primary air supply.

The lack of primary air must be compensated for by supplying secondary air towards the flames in order to ensure a complete combustion, resulting in values of CO, $CO_2$ and $NO_x$ emissions compliant with the gas regulations currently in force.

Single burners are also known in the art which include a flame divider or cap having a plurality of apertures adapted to generate a "carpet flame", i.e., a flame that propagates out of the system of burners in a substantially axial direction with respect to the axis of the system of burners, and therefore in a direction which is substantially orthogonal to a visible surface of the cooking top.

A carpet flame may be a total carpet flame or a perimetric carpet flame, depending on whether it covers a geometric figure (generally a circle) entirely or just the peripheral portion of said geometric figure (generally a circular crown).

Also in the case of a perimetric carpet flame, a plurality of concentric rows of apertures may be provided and adapted to generate a "carpet flame", in particular for the purpose of also heating the central portion of the base of a cooking vessel positioned over the gas burner.

However, the solutions known in the art suffer from a few drawbacks.

In particular, in the solutions currently known in the art, "double-crown" systems of burners include a gas inlet duct centrally coupled to the outer burner; this type of coupling results in the primary air-gas mixture impacting against the inner wall of the central cup of the inner burner, thus being drastically slowed and suddenly diverted upwards, which may lead to considerable differences in the velocity at which the primary air/gas mixture will exit through the holes of the flame divider in the areas corresponding to this flow.

The solutions known in the art suffer from the drawback that there are zones where the exit velocity of the primary air/gas mixture is different through the various perforated regions of the flame dividers, which may result in "flame lift" phenomena at ignition time.

SUMMARY

An object of the present device to provide a system of gas burners, in particular for a cooking top for household use, and an associated cooking top which are adapted to overcome the drawbacks of prior-art solutions.

It is therefore one object of the present device to provide a system of gas burners and an associated cooking top which are so realized as to prove particularly efficient and economical, allowing safe and optimal ignition of the system of burners (particularly of the outer burner) and preventing the phenomenon known as "flame lift", caused by improper entry of gas or primary air/gas mixture into the system of burners.

It is thus apparent that one object of the present device is to provide a system of gas burners which is so realized as to ensure better uniformity of the exit velocity of the primary air/gas mixture through the apertures of the flame divider or cap.

It is another object of the present device to provide a system of gas burners which is so realized as to ensure optimal gas efficiency while at the same time lowering its production costs.

Said objects are achieved by the present device through a system of gas burners, in particular for a cooking top for household use, and an associated cooking top incorporating the features set out in the appended claims, which are intended to be an integral part of the present description.

BRIEF DESCRIPTION OF THE DRAWINGS

Further objects, features and advantages of the present device will become apparent from the following detailed description and from the annexed drawings, which are supplied by way of non-limiting example, wherein.

DETAILED DESCRIPTION OF EMBODIMENTS

Figure 1:
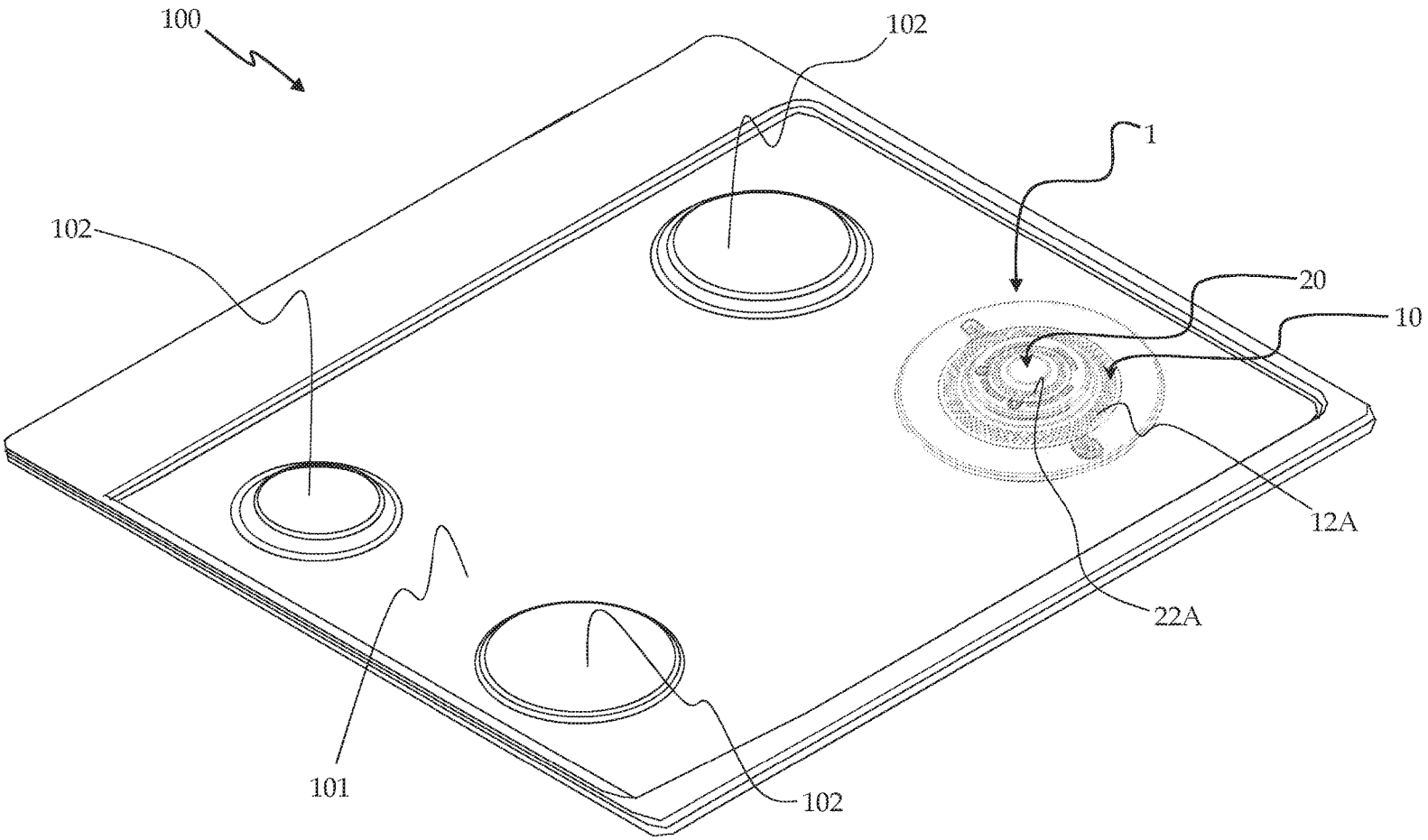
FIG. 1 is a perspective view of a cooking top and a system of gas burners making up one possible aspect of the present device.

Referring now to FIG. 1, reference numeral 100 designates a cooking top according to the present device, in particular intended for household use and of the built-in type.

The cooking top 100 is so shaped as to include a substantially flat visible surface 101 (usually defined as "cover" by those skilled in the art), on which a plurality of housings 102 are formed for accommodating at least one system of gas burners 1 according to the present device.

Said visible surface 101 may then be associated with a lower portion (not shown) of the cooking top 100, said lower portion being commonly referred to as "hob bottom box" by those skilled in the art.

The cooking top 100 may also include supporting means (not shown) for cooking vessels containing foods to be cooked, said supporting means being adapted to ensure an adequate separation distance between the visible surface 101 of the cooking top 100 and said cooking vessels.

In addition, the cooking top 100 may include interfacing means (not shown) adapted to, among other things, allow adjusting and/or displaying the operating parameters of the system of burners 1 and of other burners (also not shown) associated with the cooking top 100. For example, the interfacing means may include a "touch control" interface, or a mechanical interface, for controlling at least one intercepting tap.

As can be seen in FIGS. 2 to 6, the system of burners 1 adapted for installation in a cooking top 100 according to the present device includes a pair of substantially concentric burners 10, 20, said pair of burners 10, 20 made up of:

- an outer burner 10 equipped with a first cup 11 and a first flame divider 12; and
- an inner burner 20 equipped with a second cup 21 and a second flame divider 22.

The first flame divider 12 and the second flame divider 22 include, respectively, a plurality of first apertures 12A and a plurality of second apertures 22A to allow an air-gas mixture (indicated by dashed arrows designated "AG" in FIGS. 4 and 5) to exit, said first apertures 12A and second apertures 22A being so realized as to extend substantially parallel to a vertical axis of symmetry A-A (shown in FIGS. 2, 3*b* and 6) of the system of gas burners 1.

In substance, the outlet section of the first apertures 12A and second apertures 22A is substantially parallel to the visible surface 101 of the cooking top 100, or slightly inclined relative to said visible surface 101. For example, the outlet section of the first apertures 12A and second apertures 22A may be slightly inclined relative to a horizontal plane (i.e. a plane which is substantially parallel to the visible surface 101), e.g. by an angle between 0° and 30°, in particular an angle substantially equal to 15°.

The particular realization of the first apertures 12A and second apertures 22A can be especially appreciated in a sectional view and when viewed in a direction substantially perpendicular to the axis A-A of the system of gas burners 1.

As a consequence, said first apertures 12A and second apertures 22A are clearly realized in such a way as to generate a flame that propagates outwards from the system of gas burners 1 in a direction substantially parallel to said axis A-A of the system of gas burners 1, said first apertures 12A and second apertures 22A being thus so realized as to generate a "carpet flame", i.e. a flame that propagates outwards in a substantially vertical direction or anyway in a direction inclined by a very small angle relative to the vertical.

Preferably, the concentration of the first apertures 12A and second apertures 22A is in the range of one to ten per square centimeter ($cm^2$); as a result, the distance between each one of said first apertures 12A and each one of said second apertures 22A is not excessive, thus promoting flame propagation, while at the same time not being too small, so as to allow a sufficient supply of secondary air.

Note that the first flame divider 12 and the second flame divider 22 provide the functions of delimiting the internal environment of the system of gas burners 1 at the top and of allowing the flame generated by the combustion of the air-gas mixture to exit the system of gas burners 1 through the plurality of first apertures 12A and second apertures 22A.

The first flame divider 12 and the second flame divider 22 can include a plurality of first apertures 12A and second apertures 22A, in particular having a diameter substantially equal to the thickness of the first flame divider 12 and second flame divider 22.

Furthermore, the first flame divider 12 and the second flame divider 22 may be situated at the same level with respect to the visible surface 101 of the cooking top 100; consequently, any means (not shown) for supporting cooking vessels containing foods to be cooked can have a reduced height, in accordance with the current design trends.

The first cup 11 of the outer burner 10 and the second cup 21 of the inner burner 20 may be made of die-cast aluminum; also, the first chamber 11A of the first cup 11 and the second chamber 21A of the second cup 21 are defined at the top by said first flame divider 12 and said second flame divider 22, respectively.

The first cup 11 of the outer burner 10 includes a first Venturi element 13 for supplying an air-gas mixture to a first chamber 11A of said first cup 11, and the second cup 21 of the inner burner 20 includes a second Venturi element 23 for supplying an air-gas mixture to a second chamber 21A of said second cup 21.

It should be taken into account that, for the purposes of the present device, the terms "vertical", "horizontal", etc. are used with reference to a system of gas burners 1 installed on a cooking top 100.

In various embodiments, the first Venturi element 13 is made as one piece with the first cup 11 of the outer burner 10, and the second Venturi element 23 is made as one piece with the second cup 21 of the inner burner 20; however, it is clear that the first Venturi element 13 and the second Venturi element 23 may also be made separately from said outer burner 10 and inner burner 20, and then associated with said outer burner 10 and inner burner 20. In addition, the first Venturi element 13 and the second Venturi element 23 may be made as parts of a duct that includes them, or may themselves substantially constitute said duct in its entirety.

In accordance with the present device, the first Venturi element 13 and the second Venturi element 23 are positioned to define, respectively, a first longitudinal axis of symmetry A1 and a second longitudinal axis of symmetry A2 arranged substantially horizontally (as shown in FIGS. 3*a*, 3*b*, 4 and 5 by means of a dashed-dotted line), said first Venturi element 13 being associated with the first cup 11 in a manner such that said first axis A1 is located on the outside of an inner wall 11B of the cup 11.

In substance, said first Venturi element 13 is associated with the first cup 11 in such a way that said first axis A1 will not intersect said inner wall 11B of the cup 11; in a borderline case, said first axis A1 may be positioned tangentially relative to said inner wall 11B of the cup 11.

In various embodiments, the inner wall 11B of the cup 11 is preferably located on the outside of a projection along said first axis A1 of the outlet section (i.e., the section that enters the first chamber 11A) of the first Venturi element 13; it should be noted that in such a borderline situation (i.e., a situation in which the first axis A1 is positioned tangentially relative to said inner wall 11B), the inner wall 11B of the first cup 11 is typically located on the outside of at least half the projection of the outlet section of the first Venturi element 13.

Said first Venturi element 13 is associated with a partition 13A entering the first chamber 11A and positioned substantially parallel to the first axis A1 of the first Venturi element 13 and substantially tangent to the inner wall 11B of the cup 11.

In substance, said partition 13A constitutes some sort of extension of the first Venturi element 13, in particular an extension that enters the first chamber 11A in such a way as to form a sort of guide for the air-gas mixture coming from the first Venturi element 13 and flowing into the first chamber 11A of the cup 11; it is therefore clear that this provision also allows the first Venturi element 13 to be substantially tangent to the inner wall 11B of the cup 11. It is also clear (as can be seen in the annexed drawings) that the first Venturi element 13 is associated with the first cup 11 in a manner such that the flow of air-gas mixture being fed to said first chamber 11A will be tangent to said inner wall 11B of the first cup 11.

As a consequence, the first Venturi element 13 is associated with the first cup 11 in such a way that the inner wall 11B of the first cup 11 will not be directly hit by the flow of air-gas mixture exiting the first Venturi element 13.

The provisions of the present device allow, therefore, providing a system of gas burners 1 which is so realized as to prevent the air-gas mixture coming from the first Venturi element 13 from impacting directly against the inner wall 11B of the cup 11 and from being drastically slowed down and suddenly diverted upwards.

As a consequence, the provisions of the present device allow preventing said air-gas mixture from flowing out of said first apertures 12A of the first flame divider 12 at significantly different velocities, thus avoiding the onset of phenomena of incomplete ignition of the flame that should be produced by the outer burner 10, in particular because of the phenomenon known as "flame lift".

It is therefore apparent that the peculiar realization of the system of gas burners 1 according to the present device ensures better homogenization of the primary air/gas mixture, and hence better velocity distribution, resulting in optimal gas efficiency, while also reducing the costs incurred for manufacturing the system of gas burners 1.

The first cup 11 and the first chamber 11A have a substantially toroidal shape, wherein the inner wall 11B of the first cup 11 delimits a space suitable for receiving the second cup 21 of the inner burner 20; in particular, said inner wall 11B has a tubular and substantially cylindrical or truncated conical shape. In substance, when viewed from above, the first cup 11 is substantially shaped like a circular crown, and the second cup 21 is arranged substantially concentric in the central hole of the first cup 11, said central hole being delimited by the inner wall 11B of the first cup 11. Besides, for the purpose of reducing the number of parts making up the system of gas burners 1 of the present device, the first cup 11 and the second cup 21 may be joined together.

In various embodiments, the first Venturi element 13 and the second Venturi element 23 are positioned side by side, in particular in a manner such that the first axis A1 and the second axis A2 are substantially parallel and substantially lie in the same horizontal plane.

Figure 3A:
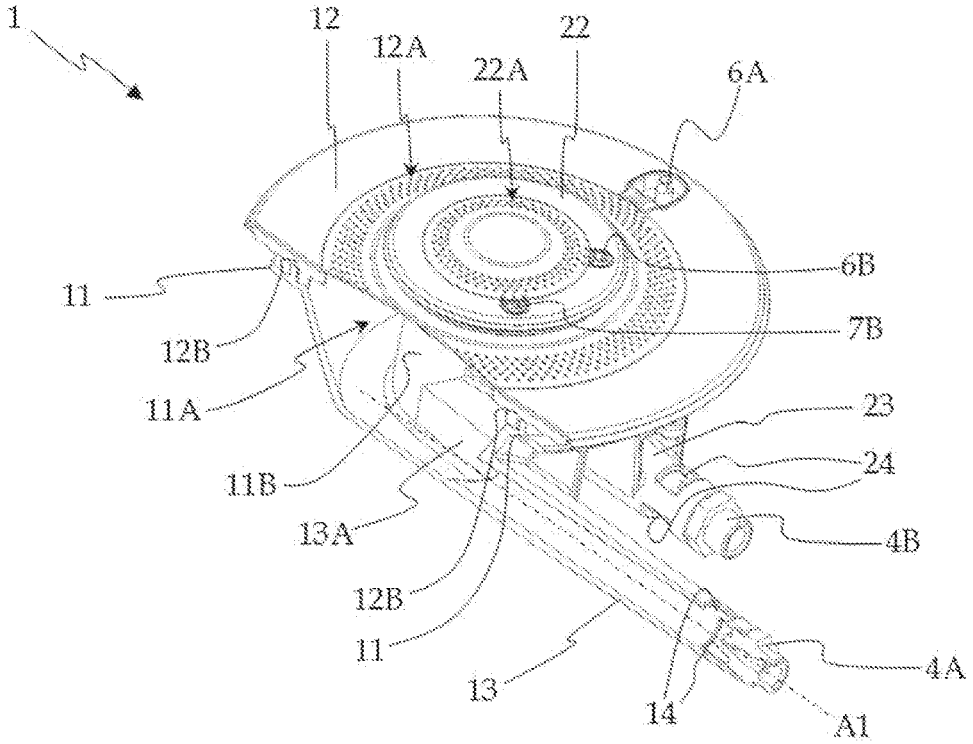
FIGS. 3*a* and 3*b* are perspective views of a first section and a second section, respectively, of the system of gas burners according to the present device relative to a vertical plane.
Figure 3B:
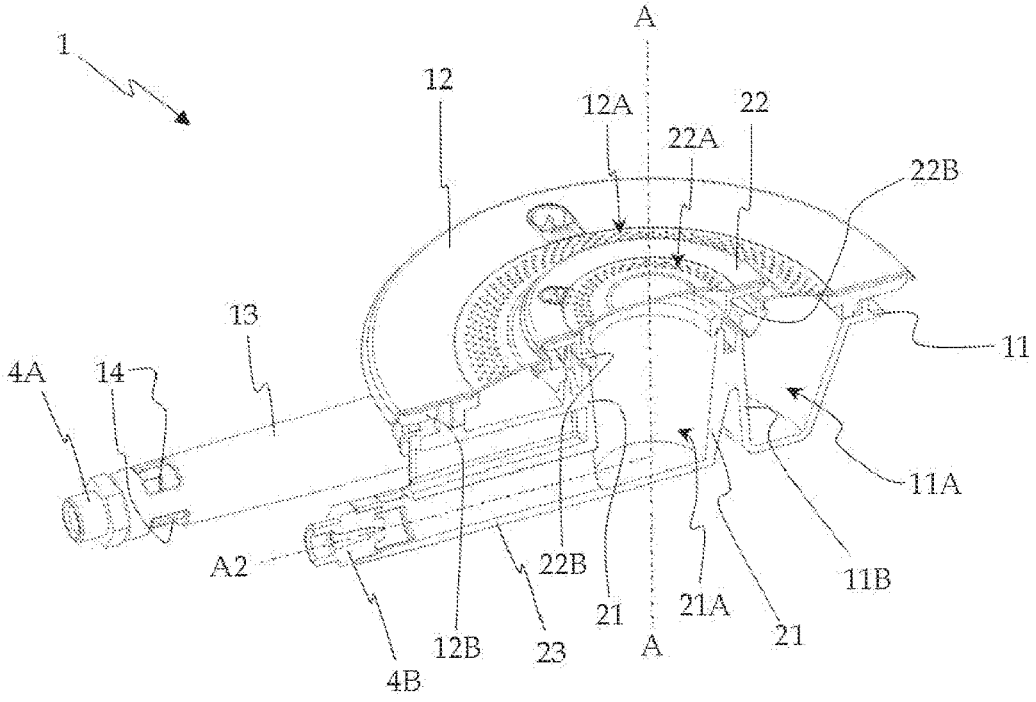
Figure 4:
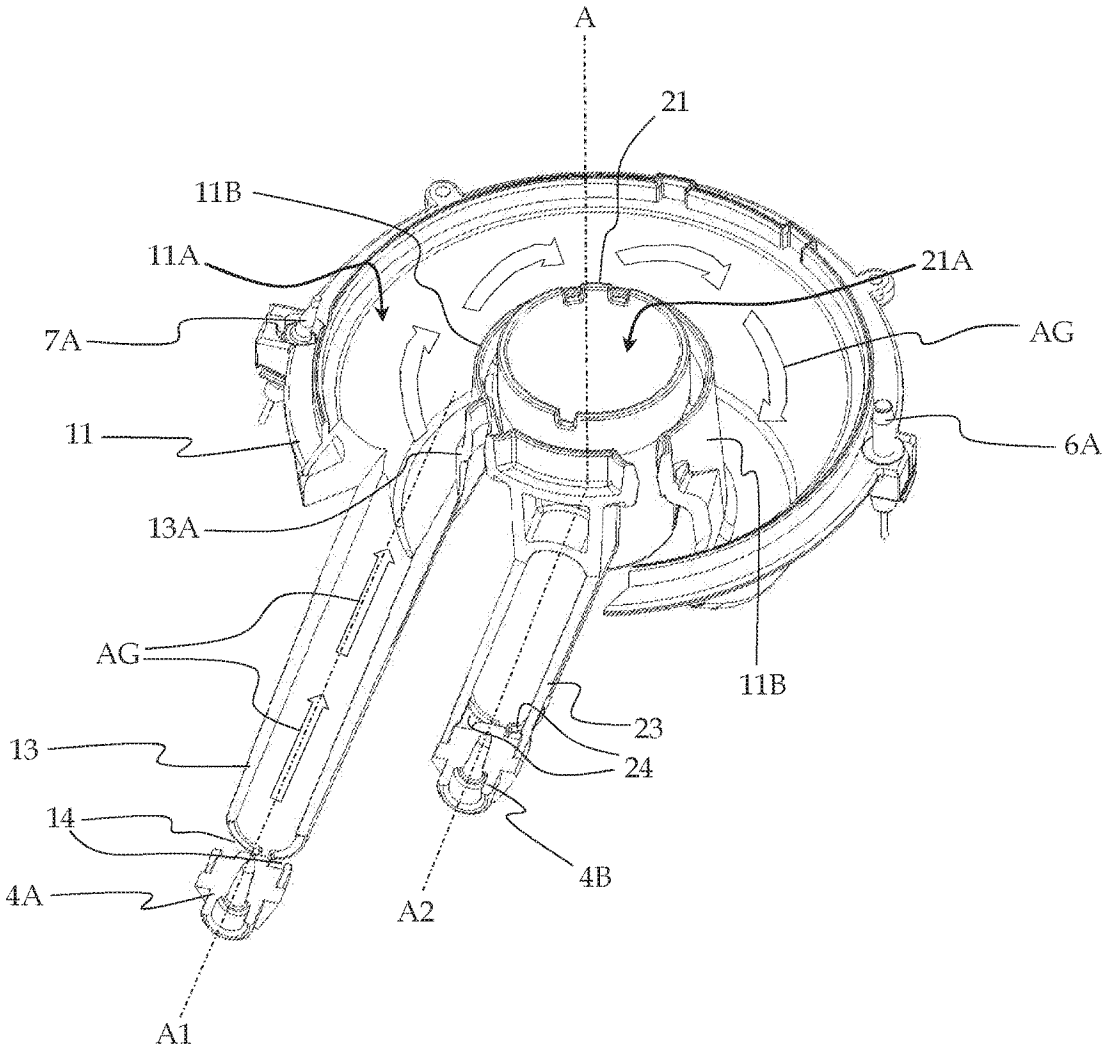
FIG. 4 is a perspective view of a section relative to a horizontal plane of the system of gas burners according to the present device.
Figure 5:
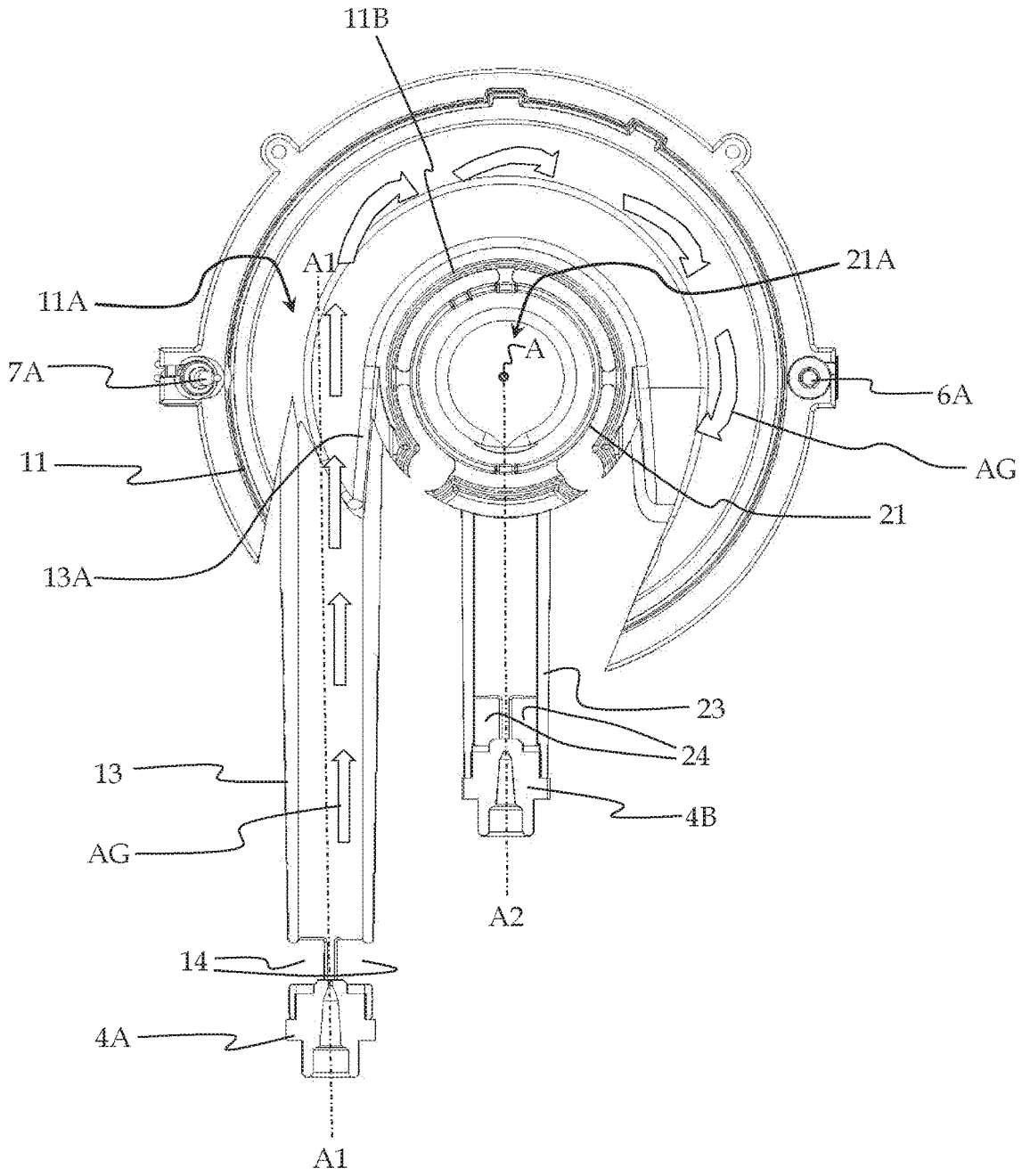
FIG. 5 is a top view of the section of FIG. 4.

In FIGS. 3*b* and 5, it can be noticed that the first axis A1 of the first Venturi element 13 and the second axis A2 of the second Venturi element 23 are positioned in planes orthogonal to the plane in which the axis A-A of the system of gas burners 1 lies, said second axis A2 being positioned in such a way as to intersect the axis A-A of the system of gas burners 1.

In accordance with the present device, the first Venturi element 13 receives a gas coming from a first injector 4A, and the second Venturi element 23 receives a gas coming from a second injector 4B.

The first Venturi element 13 is associated with at least one first air intake 14 to allow entry of primary air, in particular said at least one first air intake 14 being associated with the first Venturi element 13 downstream of the first injector 4A with reference to the gas path.

Also, the second Venturi element 23 is associated with at least one second air intake 24 to allow entry of primary air, in particular said at least one second air intake 24 being associated with the second Venturi element 23 downstream of the second injector 4B with reference to the gas path.

As is known, the first Venturi element 13 and the second Venturi element 23 create a pressure drop that drags primary air into them; the gas (enriched with primary air, i.e., the air-gas mixture) is then conveyed towards the combustion area of the system of gas burners 1.

It is also worth specifying the meaning of the terms "primary air" and "secondary air" as used in the present description. "Primary air" is air mixed with fuel gas inside the system of gas burners 1, whereas "secondary air" is air added to the already formed air-gas mixture in the area outside the cooking top 100 near the first apertures 12A and second apertures 22A of the system of gas burners 1, said "secondary air" being supplied when the flame has been ignited and being necessary for providing the additional oxygen required for a proper combustion.

In order to ensure a stoichiometrically correct mixture of gas and primary air as a function of the combustion process to which the air-gas mixture will then have to be subjected, said at least one first air intake 14 and said at least one second air intake 24 are sufficiently large to ensure an adequate flow of primary air through them. In the event that natural circulation should not guarantee a sufficient primary air flow rate to properly supply primary air to the system of gas burners 1, a primary air forced circulation system (not shown in the annexed drawings) may be associated with said system of gas burners 1.

Therefore, it is clear that the system of gas burners 1 according to the present device is designed to allow dragging a quantity of primary air in the range of 60% to 70% of the stoichiometric value, i.e., the quantity of air that would be necessary to ensure a proper combustion. Thus, the provisions of the present device ensure an adequate flow of secondary air to reach an optimal stoichiometric value.

It is apparent from the above description that the system of gas burners 1 according to the present device is of the type that takes primary air from below the cooking top 100.

In a preferred embodiment, the system of gas burners 1 according to the present device can include a first tube and a second tube (not shown) associated with the injectors 4A, 4B and with independent control valves (also not shown), so that the outer burner 10 and the inner burner 20 can be used either jointly or separately. Consequently, in such an embodiment, the system of gas burners 1 is of the double-crown, double-control type, and ensures good variability and a homogeneous distribution of the heat to be supplied to a cooking container positioned over said system of gas burners 1. It is however clear that the system of gas burners 1, according to the present device, may also be of the double-crown, single-control type, i.e., realized in such a way that the outer burner 10 and the inner burner 20 will be fed by a common gas inlet duct associated with a common tap or control valve (not shown).

In various embodiments, the first cup 11 and the first chamber 11A have a substantially toroidal shape, wherein the inner wall 11B of the first cup 11 delimits a central hole suitable for receiving the second cup 21 of the inner burner 20.

Figure 2:
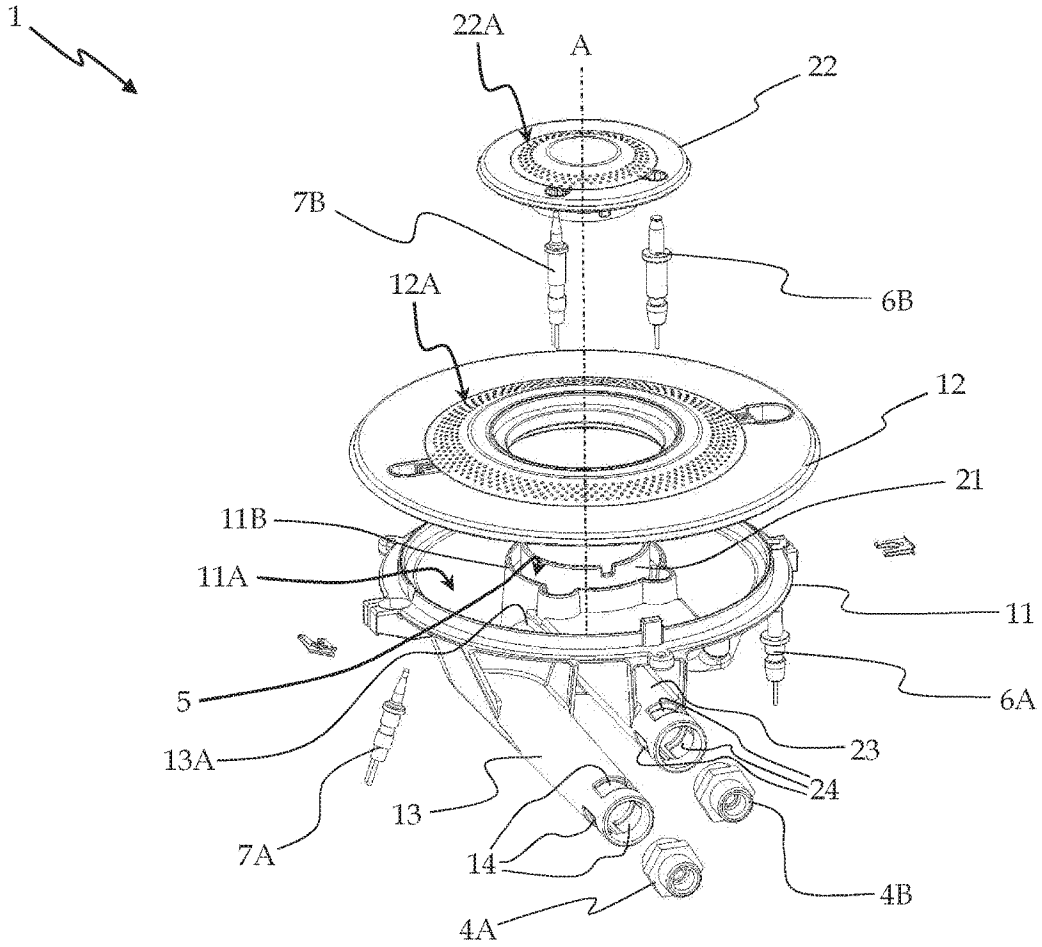
FIG. 2 is a schematic exploded perspective view of a system of gas burners according to the present device.

As is mostly visible in FIGS. 2, 6 and 7, the system of gas burners 1 according to the present device include at least one opening 5 formed between the inner wall 11B of the first cup 11 and the second cup 21 of the inner burner 20 to allow the passage of secondary air (indicated by dashed arrows designated as AS in FIG. 6) taken from below the system of gas burners 1 (and also below the cooking top 100).

Typically, said at least one opening 5 is associated with at least one first passage 15 (shown in FIG. 6 and FIG. 7) located between the upper portion of an inner edge of the first flame divider 12 and the lower portion of an outer edge of the second flame divider 22, so as to supply an adequate quantity of secondary air to the first apertures 12A (in particular, those first apertures 12A which are proximal to said inner edge of the first flame divider 12).

Preferably, the second flame divider 22 lies in a horizontal plane which is higher than a horizontal plane in which the first flame divider 12 lies, said second flame divider 22 being so realized as to extend over said at least one first passage 15; such a realization of the second flame divider 22 prevents any liquid that might be spilled during the cooking process from flowing into said at least one first passage 15.

Figure 6:
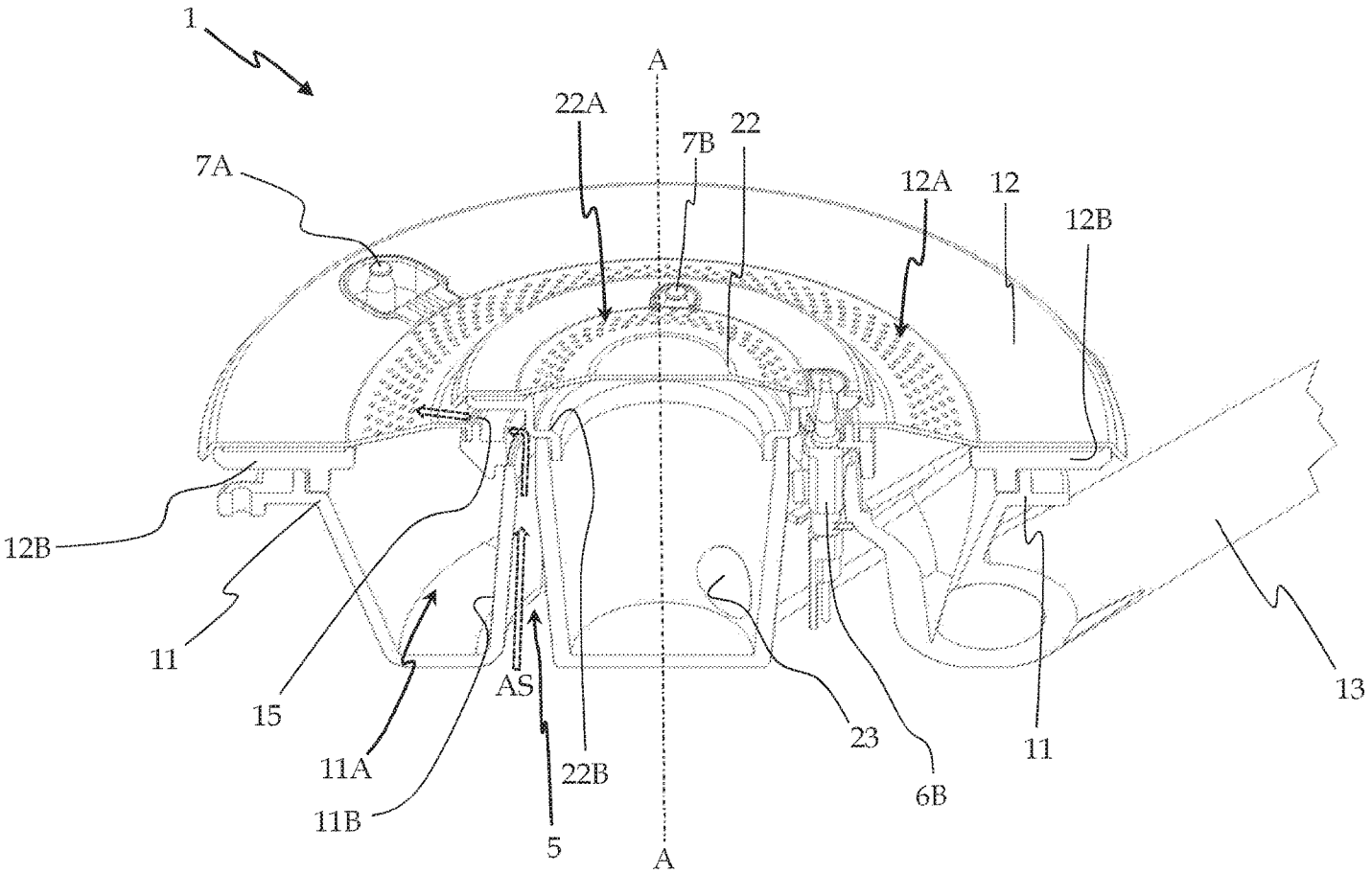
FIG. 6 is a perspective view of a further section relative to a vertical plane of the system of gas burners according to the present device.
Figure 7:
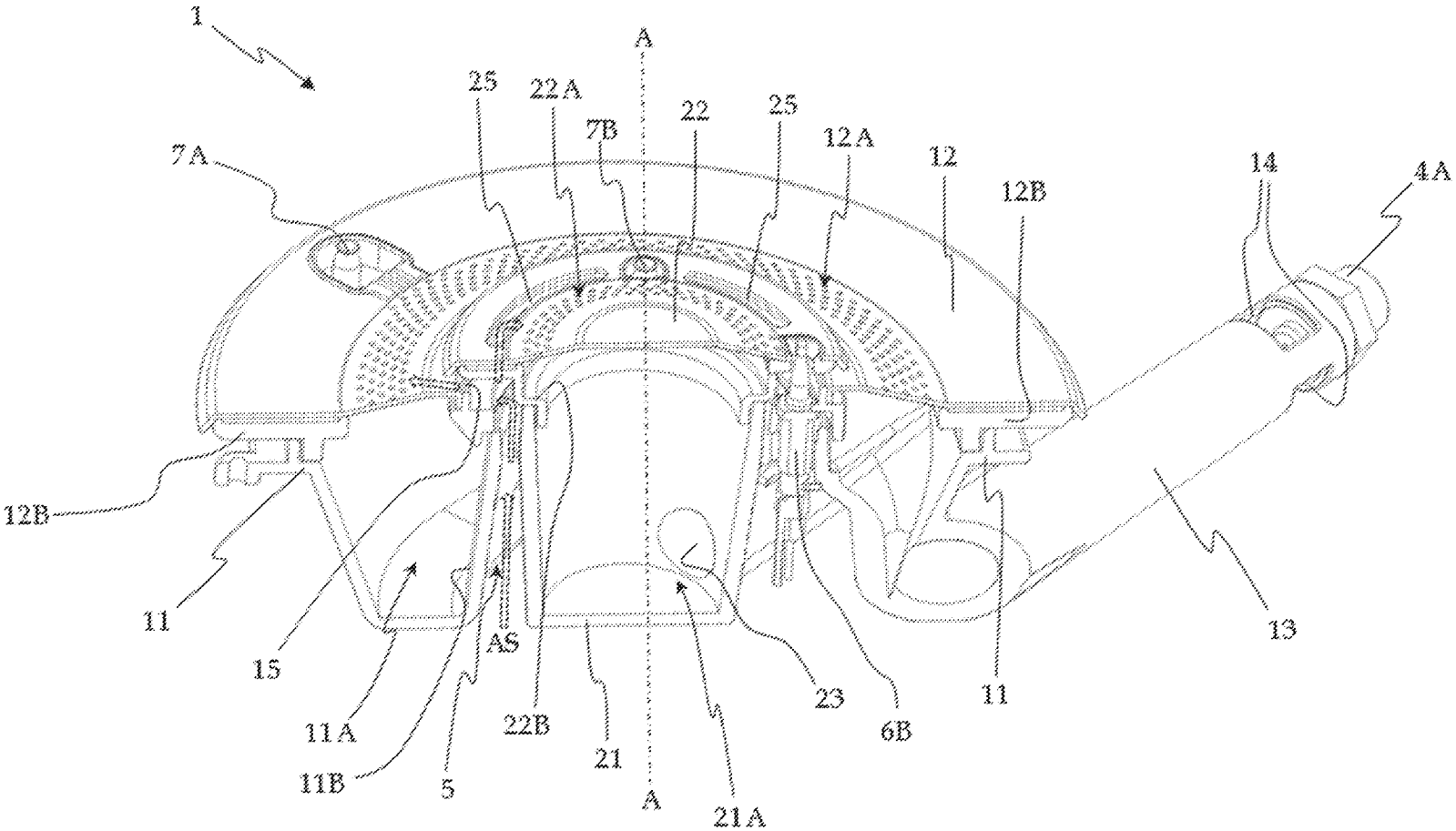
FIG. 7 is a perspective view of a section relative to a vertical plane of an aspect of the system of gas burners.

FIG. 7 shows an embodiment of the system of gas burners 1 which may be alternative to the one shown in FIG. 6.

In the embodiment of FIG. 7, said at least one opening 5 is preferably associated with at least one second passage 25 located between the second apertures 22A (in particular, the outer crown of said second apertures 22A) and the outer edge of the second flame divider 22, so as to supply an adequate quantity of secondary air to said second apertures 22A. Preferably, said at least one second passage 25 is shaped substantially like an eyelet, in particular an eyelet shaped like a circular crown sector. Also, said at least one second passage 25 includes a plurality of second passages 25 located between the second apertures 22A and the outer edge of the second flame divider 22.

Typically, said at least one second passage 25 is additional to said at least one first passage 15; however, said at least one second passage 25 may also be alternative to or substitutive of said at least one first passage 15.

In accordance with the present device, the first flame divider 12 is associated with a first frame 12B that allows coupling said first flame divider 12 to the first cup 11 of the outer burner 10.

Preferably, said first frame 12B is made of die-cast aluminum, and the first flame divider 12 is made from enamelled sheet metal, the union between the first flame divider 12 and the first frame 12B being accomplished through fastening means.

Said first frame 12B allows the second apertures 22A of the second flame divider 22 to be kept in a slightly raised position relative to the cooking top 100 for the purpose of improving the supply of secondary air to the inner burner 20, so as to prevent the flames of said inner burner 20 from interfering with the flames of the outer burner 10.

In various embodiments, the second flame divider 22 is associated with a second frame 22B that allows coupling said second flame divider 22 to the second cup 21 of the inner burner 20.

In this case as well, said second frame 22B is made of die-cast aluminum, and the second flame divider 22 is made from enamelled sheet metal, the union between the second flame divider 22 and the second frame 22B being accomplished through fastening means.

It should also be noted that the system of gas burners 1, according to the present device, may include one or more of the following components:

- at least one first ignition spark plug 6A, which allows igniting the air-gas mixture coming out of the first apertures 12A of the first flame divider 12;
- at least one first temperature sensor 7A (also known as thermocouple) associated with said first apertures 12A;
- at least one second ignition spark plug 6B, which allows igniting the air-gas mixture coming out of the second apertures 22A of the second flame divider 22;
- at least one second temperature sensor 7B associated with said second apertures 22A.

The first temperature sensor 7A and the second temperature sensor 7B interrupt the gas supply if the detected temperature falls below a predefined minimum value, the occurrence of such a condition being a signal for detecting that the air-gas mixture has not been ignited, resulting in the automatic closure of the on-off valve (not shown in the drawings) that supplies gas to of the system of gas burners 1.

It should be noted that the first ignition spark plug 6A and the first temperature sensor 7A are associated with the outer burner 10, whereas the second ignition spark plug 6B and the second temperature sensor 7B are associated with the inner burner 20; it is clear that the outer burner 10 and the inner burner 20 may include connection means for associating said ignition spark plugs 6A, 6B and said temperature sensors 7A, 7B with the system of gas burners 1.

The features and advantages of the system of gas burners 1, in particular for a cooking top 100 for household use, and of the associated cooking top 100 according to the present device, are apparent in the light of the above description.

In particular, the provisions of the present device allow providing a system of gas burners 1 which is so realized as to prevent the air-gas mixture coming from the first Venturi element 13 from impacting directly against the inner wall 11B of the cup 11 and from being drastically slowed down and suddenly diverted upwards.

As a consequence, the provisions of the present device allow preventing said air-gas mixture from flowing out of said first apertures 12A of the first flame divider 12 at significantly different velocities, thus avoiding the onset of phenomena of incomplete ignition of the flame that should be produced by the outer burner 10, in particular because of the phenomenon known as "flame lift".

It is therefore apparent that the peculiar design of the system of gas burners 1 according to the present device ensures a more uniform velocity of exit of the primary air/gas mixture through the first apertures 12A of the first flame divider 12, resulting in optimal gas efficiency, while also reducing the costs incurred for manufacturing the system of gas burners 1.

The presence of at least one opening 5 formed between the inner wall 11B of the first cup 11 and the second cup 21 of the inner burner 20, and of said at least one first passage 15 and at least one second passage 25, allows supplying an adequate quantity of secondary air, taken from below the system of gas burners 1, to the first apertures 12A of the first flame divider 12 and to the second apertures 22A of the second flame divider 22. Accordingly, an adequate amount of oxygen can be supplied to the first apertures 12A and to the second apertures 22A to ensure a proper combustion.

In addition, the system of gas burners 1 according to the present device is particularly effective, in that it ensures optimal gas efficiency due to the first apertures 12A and second apertures 22A, which produce a "carpet flame".

Another advantage of the system of gas burners 1, according to the present device, is that it avoids the creation of zones where the exit velocity of the primary air-gas mixture is different in the various perforated regions of the flame dividers 12, 22; as a consequence, the particular realization of the system of gas burners 1, according to the present device, allows preventing the occurrence of "flame lift" phenomena, particularly at ignition time.

It is however clear that many changes may be made to the system of gas burners 1, in particular for a cooking top 100 for household use, and to the associated cooking top 100 according to the present device, and that in its practical implementation the various components may have different shapes and arrangements or be replaced with other technically equivalent elements without departing from the novelty spirit of the concept.

In particular, the present description has disclosed in detail a system of gas burners 1 and a cooking top 100 particularly suited for use in a household environment. Nevertheless, the present device may also be conveniently implemented in systems of gas burners 1 and cooking tops 100 for different applications, e.g., in the hotel industry.

It can therefore be easily understood that the present device is not limited to the above-described system of gas burners 1 and associated cooking top 100, but may be subject to many modifications, improvements or replacements of equivalent parts and elements without departing from concept.

The invention claimed is:

1. A system of gas burners for a cooking top having a pair of concentric burners, the pair of concentric burners comprising:

an outer burner equipped with a first cup and a first flame divider;

an inner burner equipped with a second cup and a second flame divider, wherein the first flame divider and the second flame divider include, respectively, a plurality of first apertures and a plurality of second apertures to allow an air-gas mixture to exit, said plurality of first apertures and said plurality of second apertures being oriented to extend parallel to a vertical axis of symmetry of the inner and outer burners;

a first Venturi element of the first cup of the outer burner for supplying the air-gas mixture to a first chamber of the first cup; and a second Venturi element of the second cup of the inner burner for supplying the air-gas mixture to a second chamber of said second cup, wherein the first Venturi element and the second Venturi element include a first longitudinal axis of symmetry and a second longitudinal axis of symmetry, respectively, that are arranged horizontally, and wherein the first Venturi element is disposed relative to the first cup such that the first longitudinal axis of symmetry is located on an outside of an inner wall of the first cup, and wherein the first Venturi element is associated with a guide partition entering the first chamber that is positioned parallel to the first longitudinal axis of symmetry of the first Venturi element and wherein the guide partition is integral with and tangential to the inner wall of the first cup.

2. The system of gas burners according to claim 1, wherein the first cup and the first chamber have a toroidal shape, wherein the inner wall of the first cup delimits a space suitable for receiving the second cup of the inner burner, wherein the inner wall defines a tubular shape and one of a cylindrical and truncated conical shape.

3. The system of gas burners according to claim 1, wherein the first Venturi element and the second Venturi element are positioned side by side such that the first longitudinal axis of symmetry and the second longitudinal axis of symmetry are parallel.

4. The system of gas burners according to claim 1, wherein at least one opening is formed between the inner wall of the first cup and the second cup of the inner burner to allow passage of secondary air taken from an area below the outer and inner burners.

5. The system of gas burners according to claim 4, wherein the at least one opening is associated with at least one first passage located between an upper portion of an inner edge of the first flame divider and a lower portion of an outer edge of the second flame divider.

6. The system of gas burners according to claim 5, wherein the at least one opening is associated with at least one second passage located between the second apertures and the outer edge of the second flame divider.

7. The system of gas burners according to claim 6, wherein the at least one second passage is shaped to define an eyelet having a circular crown sector.

8. The system of gas burners according to claim 1, wherein the first flame divider is associated with a first frame that allows coupling of the first flame divider to the first cup of the outer burner.

9. The system of gas burners according to claim 8, wherein the first frame is made of die-cast aluminum and the first flame divider is made from enameled sheet metal, and wherein the first flame divider is connected to the first frame.

10. The system of gas burners according to claim 8, wherein the second flame divider is associated with a second frame that allows coupling of the second flame divider to the second cup of the inner burner.

11. The system of gas burners according to claim 10, wherein the second frame is made of die-cast aluminum and the second flame divider is made from enameled sheet metal, and wherein the second flame divider is connected to the second frame.

12. The system of gas burners according to claim 1, wherein the first cup of the outer burner and the second cup of the inner burner are made of die-cast aluminum, and wherein the first chamber of the first cup and the second chamber of the second cup are defined by the first flame divider and by said second flame divider, respectively.

13. The system of gas burners according to claim 1, wherein the first flame divider and the second flame divider are situated at a similar level relative to a visible surface of the cooking top.

14. A cooking top comprising:

a pair of concentric burners including an outer burner equipped with a first cup and a first flame divider and an inner burner equipped with a second cup and a second flame divider, wherein the first flame divider and the second flame divider include, respectively, a plurality of first apertures and a plurality of second apertures to allow an air-gas mixture to exit, said plurality of first apertures and said plurality of second apertures being oriented to extend parallel to a vertical axis of symmetry of the inner and outer burners;

a first Venturi element of the first cup of the outer burner for supplying the air-gas mixture to a first chamber of the first cup; and a second Venturi element of the second cup of the inner burner for supplying the air-gas mixture to a second chamber of said second cup, wherein the first Venturi element and the second Venturi element include a first longitudinal axis of symmetry and a second longitudinal axis of symmetry, respectively, that are arranged horizontally, and wherein the first Venturi element is disposed relative to the first cup such that the first longitudinal axis of symmetry is located on an outside of an inner wall of the first cup, and wherein the first Venturi element tangentially engages the inner wall of the first cup to define a guide partition.

* * * * *